US010381744B1

(12) United States Patent
Bank

(10) Patent No.: US 10,381,744 B1
(45) Date of Patent: Aug. 13, 2019

(54) WIDE BAND OMNI DIRECTIONAL ANTENNA

(71) Applicant: Michael Bank, Jerusalem (IL)

(72) Inventor: Michael Bank, Jerusalem (IL)

( * ) Notice: Subject to any disclaimer, the term of this patent is extended or adjusted under 35 U.S.C. 154(b) by 0 days.

(21) Appl. No.: 16/213,738

(22) Filed: Dec. 7, 2018

(51) Int. Cl.

| | |
|---|---|
| ***H01Q 21/20*** | (2006.01) |
| ***H01Q 3/42*** | (2006.01) |
| ***H01Q 3/22*** | (2006.01) |
| ***H01Q 5/15*** | (2015.01) |
| ***H01Q 9/30*** | (2006.01) |

(52) U.S. Cl.
CPC ..... *H01Q 21/205* (2013.01); *H01Q 3/22* (2013.01); *H01Q 3/42* (2013.01); *H01Q 5/15* (2015.01); *H01Q 9/30* (2013.01)

(58) Field of Classification Search
CPC ..... H01Q 21/205; H01Q 11/06; H01Q 11/10; H01Q 3/22; H01Q 3/42
See application file for complete search history.

(56) References Cited

U.S. PATENT DOCUMENTS 4,814,777 A * 3/1989 Monser ..... H01Q 21/205 343/727
2005/0110687 A1* 5/2005 Starkie ..... H01Q 5/00 343/700 MS
2006/0170604 A1* 8/2006 Almog ..... H01Q 1/36 343/795
2007/0126637 A1* 6/2007 Habib ..... H01Q 1/36 343/700 MS
2011/0227804 A1* 9/2011 Nilsson ..... H01Q 9/28 343/840

* cited by examiner

*Primary Examiner* — Ricardo I Magallanes
(74) *Attorney, Agent, or Firm* — Henry M. Feiereisen LLC

(57) ABSTRACT

A wide band omni directional antenna, in which the radiation parameters are automatically correspond to the frequency of the emitted signal. It can be made by printing and used in small size transducers, for example in cellular telephones. The antenna radiator is formed as an electrically conductive plate, the electrically conductive plate which has a shape of a non-rectangular triangle having two lateral sides of different lengths with first ends of the lateral sides connected with one another in a point connectable to an electric signal source and other opposite second ends, and the electrically conductive plate also has a side which is opposite to the point connectable to the electric signal source and connects the opposite second ends of the lateral sides with each other thus forming a third side of the triangle of the non-rectangular triangle. The antenna can be built by using two joined triangles.

2 Claims, 10 Drawing Sheets a b

S21 = f(F)

| | | |
|---|---|---|
| 1 | 609.269 MHz | -45.33 dB |
| 2 | 717.798 MHz | -32.79 dB |
| 3 | 1.1579 GHz | -40.82 dB |
| 4 | 1.5377 GHz | -39.64 dB |
| 5 | 1.9779 GHz | -38.72 dB |
| 6 | 2.4180 GHz | -39.37 dB |
| 7 | 2.9216 GHz | -46.28 dB |

Directivity

718 MHz

| 0 degree | 45 | 90 | 135 | 180 | 225 | 270 | 315 |
|---|---|---|---|---|---|---|---|
| -39.4dBm | -41.5 | -40.5 | -38.5 | -39.4 | -40.5 | 38.9 | -40.1 |

609 MHz

| 0 degree | 45 | 90 | 135 | 180 | 225 | 270 | 315 |
|---|---|---|---|---|---|---|---|
| -40.2 dBm | -39 | -39.2 | -39.5 | -39.6 | -39 | -40 | -39.8 |

1.16 GHz

| 0 degree | 45 | 90 | 135 | 180 | 225 | 270 | 315 |
|---|---|---|---|---|---|---|---|
| -44.7 dBm | -42.4 | -42.3 | -42.7 | -44 | -43.7 | -44.3 | -43 |

WIDE BAND OMNI DIRECTIONAL ANTENNA

BACKGROUND OF THE INVENTION

The present invention generally relates to wide band antennas.

In today radiator in antennas such as dipoles, monopoles, Planar Inverted-F antennas (PIFA), log periodic antennas, fractal antennas is formed as a direct or folded electrical line, for example a wire or a printed line. The working frequencies of these antennas depend on a height or a length of their radiators. Therefore, these antennas can operate at certain frequencies only.

All existing antennas are built so as to provide a direction of the currents in the radiator for obtaining specified radiation parameters. This means that the antenna determines, which currents should flow through its radiator. The number of such currents is limited. Therefore, even antennas with a wide frequency range do not work at all frequencies of this band. A log periodical antenna is further known, and it is a wideband antenna. However, the log periodical antenna is not omni directional and it is very bulky.

A dipole and a monopole are known for its superb usage as a linear antenna. However, dipoles and also monopoles cannot be implemented as an internal antenna in devices that include a Printed Circuit Board (PCB).

For example, in cellular handsets and other mobile device, their small PCB, cannot be as a ground plane for needed potential zeroing due to small perimeter [2].

Accordingly, it is an object of the present invention to provide a wideband omni directional antenna which eliminates the above-mentioned disadvantages of the prior art antennas and has only one radiating element. The antenna of the present invention is an omni directional wide band antenna which has a radiator formed as an electrically conductive plate.

The known wide band antennas operate using several separate radiators and thus have several resonance frequencies, so that between these frequencies the parameters of the antennas deteriorate. The wide band antenna of the present invention avoids the disadvantages of the known wide band antennas by operating with needed parameters at all frequencies of a required wide frequency band.

In the antenna according to the present invention the radiator is a plate in which an infinite number of currents can flow. A main part of electric current will flow through the radiator over a distance whose length is equal to an odd number of quarters of the wavelength. As will be seen below, the resistance for such a current is minimal. Therefore, the value of this current will be maximal.

A wide band antenna according to the present invention can have a triangular form. In this case an electric signal can be fed to a lower corner point of the triangle. The two sides of an angle at the lower corner of the triangle have different lengths. A longer side is not shorter than a quarter of the wavelength of the lowest frequency of a predetermined frequency range, while a shorter side is no longer than a quarter of wavelength of the highest frequency of this frequency range. It is desirable that the small side was not a horizontal line.

When a signal is applied, the currents in the radiator can flow in different directions. Each direction is characterized by its resistance. According to the laws of electrical engineering, a maximum current will flow in the direction with a minimal resistance. Such minimal resistance will have a direction with a length equal to a quarter of the wavelength at a given frequency with which the antenna must operate. This resistance (R) is active and equals to an approximately active resistance of monopole with length equals to quarter of a wavelength. If the length of a current path is different from a quarter of wavelength, then the resistance for current will be more and will be complex (Z):

where X is a reactive part of an antenna radiation resistance. Thus, for each frequency, the radiation will be created by a current flowing over a distance with a length equals to a length of a quarter of a wave length.

Since a triangle with non-equal sides has an asymmetrical shape, its radiation can have a non-horizontal form diagram. To obtain a radiation with a symmetrical shape in a horizontal direction, two not isosceles triangles connected by sides of the same length can be used.

The proposed antenna can have an infinitely wide band, also like a monopole has a minimum active resistance not only when its length is equal to one quarter of a wave. The resistance of the proposed antenna will be minimal and with a length equal to an odd number of quarters of the wave length.

According to a further novel feature of the present invention, a length of a longest one of the lateral sides is not shorter than a quarter of a wave length of a radiation of a desired lower frequency, while a length of a shortest one of the lateral sides is no longer than a quarter of a wavelength of a radiation of a desired highest frequency.

According to a further novel feature of the present invention the electrically conductive plate has a shape of two triangles each formed as a non-rectangular triangle of claim 1 and adjoining each other by their equal sides.

According to a further novel feature of the present invention the two triangles are shortened at their sides opposite to the point connectable to the electrical signal source, and additionally connected at their shortened sides with one another by an electrically conductive strip.

According to a further novel feature of the present invention the electrically conductive plate can have a plurality of through going openings. Transceiver elements operating at frequencies below the radiating frequencies used can be placed in these openings.

The novel features of the present invention are set forth in detail in the appended claims. The invention itself however both as to its construction and its method of operation will be best understood from the following description of the preferred embodiments, which is accompanied by the following drawings.

DESCRIPTION OF THE PREFERRED EMBODIMENTS

Throughout this description the term "wideband antenna" is used to indicate a linear antenna having a single radiating element and an element for potential zeroing if it needs it. Zeroing is not needed if two same radiating elements are used like in a dipole.

Today there are many different small transducers in which it is impossible to use an antenna like a dipole. In these devices one side radiators like monopoles are used. In this case the antenna is contacted with one pole of a source. Another pole of the source must have a zero potential. It is usual in these cases to utilize a ground plane which is a Printed Circuit Board (PCB). However, if PCB is small, zeroing of potential will not be achieved. In these cases a nullifier recently has been utilized, as disclosed in [1]. There are different nullifiers for different transducers and for different frequencies.

There are many types of transducers which must work at several frequencies, for example cell phones. In these cases, an antenna are used which have several resonance frequencies, for example Planar Inverted-F Antenna (PIFA).

There are different wideband antennas which allow operation at many resonance frequencies. However, these antennas need tuning at non-resonance frequencies [2].

Figure 1:
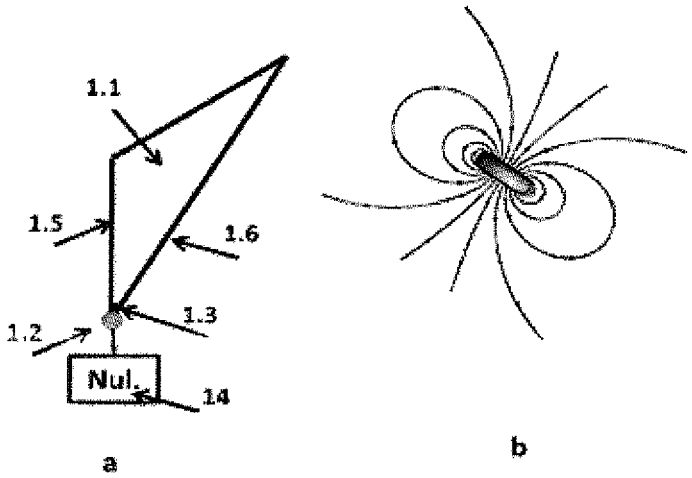
FIG. 1 of the drawings is a view showing a triangular form radiator of a wide band antenna according to the present invention for transmitting or receiving signals with wavelengths from $\lambda_L$ till $\lambda_H$.

The present antenna uses radiator resides in a flat, non-flat, or flexible surface plate for various applications. This antenna has approximately the same parameters at all frequencies without any tuning. It can work within a very wideband without using grounding. Examples below correspond to cell phones operating in frequency band 0.7-2.5 GHz FIG. 1*a* shows a radiator of the wide band antenna according to the present invention, in form of a triangular electrically conductive metal plate (1.1). The electrically conductive metal plate can be flat or can be non-flat, for example bent, etc. One port of a source of electrical signal (1.2) is connected with two plate sides in a point (1.3). Another port of the source is connected with a nullifier (1.4). The shortest side (1.5) and the longest side (1.6) of the radiator have lengths, correspondingly, not longer than one quarter of wavelength of the highest frequency and not shorter than one quarter of wavelength of the lowest frequency of a desirable frequency band of operation of the antenna. FIG. 1*b* schematically illustrates a radiation diagram of the proposed radiator.

Figure 2:
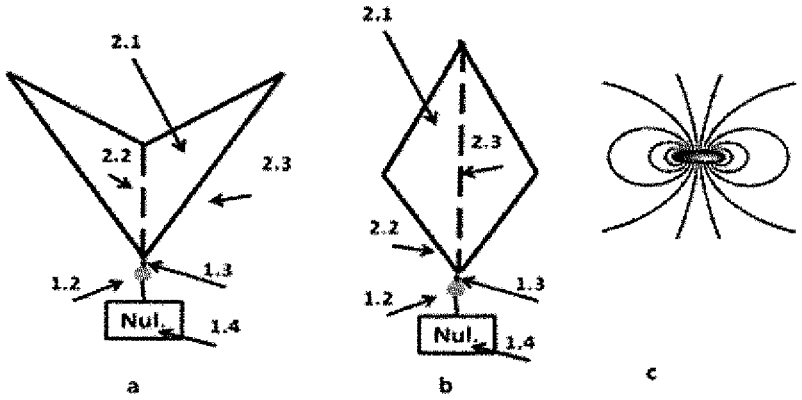
FIG. 2 of the drawings is a view showing a double triangle form radiators of the wide band antennas according to the present invention for transmitting or receiving signals with wavelengths from $\lambda_L$ till $\lambda_H$.

FIG. 2*a* schematically illustrates a proposed radiator of the wide band antenna according to the present invention, in form of a double triangle metal plate (2.1). The common side (2.2) of the triangles corresponds to one quarter of high frequency wave length. The outer sides (2.3) correspond to one quarter of low frequency wave length. FIG. 2*b* schematically illustrates a proposed radiator formed as a different double triangle formed metallic plate (2.1). The common side (2.3) corresponds to one quarter of low frequency wave length. The outer sides (2.2) correspond to one quarter of high frequency wavelength. In both triangles one port of source (1.2) is connected with two sides in a vertex (1.3). The other port of the source is connected with the nullifier (1.4). FIG. 2*c* schematically illustrates a radiation diagram of the radiators shown in FIGS. 2*a* and 2*b*.

Figure 3:
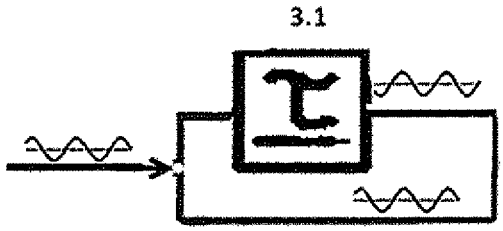
FIG. 3 of the drawings is a view showing a nullifier of the wide band antenna according to the present invention, formed on a basis of time delay.

A nullifier (3.1) using time delay of the wide band antenna according to the present invention is shown in FIG. 3. This delay is equal to half of wave signal period or an odd number of such delays in [2]. The delay line can be made as a strip line. The nullifier used in the wide band antenna according to the present invention is disclosed for example in [1] for working at one frequency.

Figure 4:
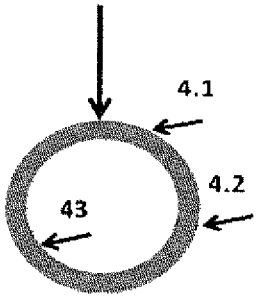
FIG. 4 of the drawings is a view showing a nullifier of the wide band antenna according to the present invention, in form of a segment of a closed line.

A nullifier of the wide band antenna according to the present invention using a closed line segment (4.1) is illustrated in FIG. 4. The external side (4.2) of this line has a length equal to half of the wavelength at low frequency. The internal side (4.3) of this line has a length equal to half the wavelength at high frequency.

Figure 5:
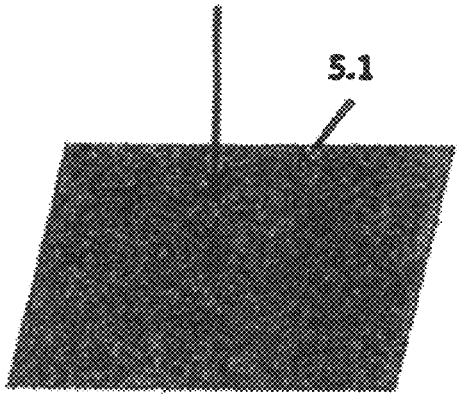
FIG. 5 of the drawings is a view showing a nullifier on a metal plate of the wide band antenna according to the present invention.

FIG. 5 schematically illustrates a further nullifier using a metal plate or PCB (5.1). The sum of sides of this nullifier must be more than half wavelength.

Figure 6:
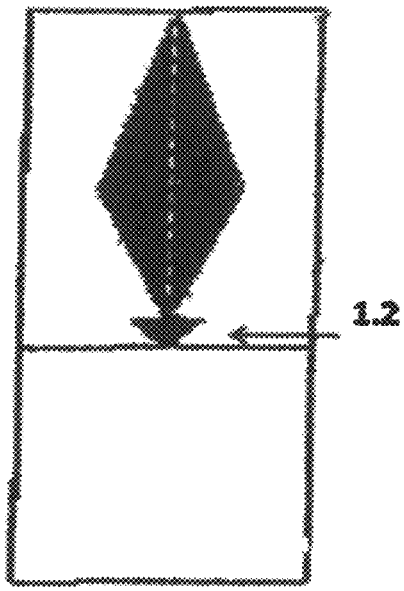
FIG. 6 of the drawings is a view showing the wide band antenna according to the present invention with a double triangle radiator and a PCB in a large cellular phone FIG. 7 of the drawings is a view showing a Voltage Standing Wave Ratio (VSWR) as a result of a simulation using the construction of the radiator shown in FIG. 6 in the wide band antenna according to the present invention.

The wide band antenna according to the present invention with a combination of the double triangle radiator (2.1) and PSB (5.1) in a "large" cellular phone is shown in FIG. 6. All dimensions of the components are provided in mm.

Figure 7:
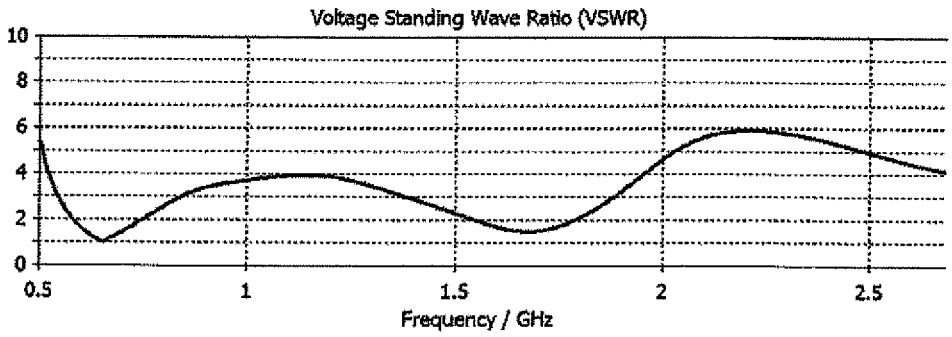
Figure 8:
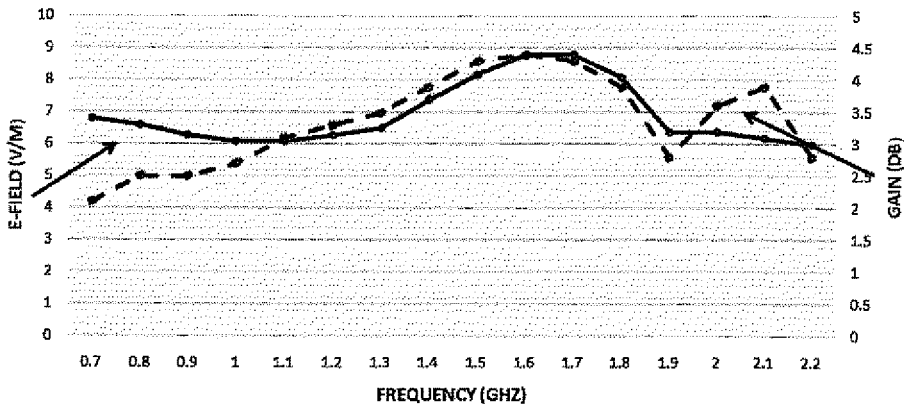
FIG. 8 of the drawings is a view showing a maximal field density at a distance 1 m and a gain as a result of a simulation using the construction of FIG. 6 in the wide band antenna according to the present invention.

In FIG. 7 of the drawings a Voltage Standing Wave Ratio (VSWR) of the wide band antenna according to the present inventions a result of simulation using the construction on FIG. 6 is presented. The source input resistance here is equal to 100 Ohm In FIG. 8 of the drawings a maximal field density of the wide band antenna according to the present invention at a distance 1 m and a gain as a result of simulation using the construction on FIG. 6 is presented. These results show that main parameters of the wide band antenna according to the present invention practically do not depend of frequency. These parameters are close to the parameters of the tuned dipoles.

Figure 9:
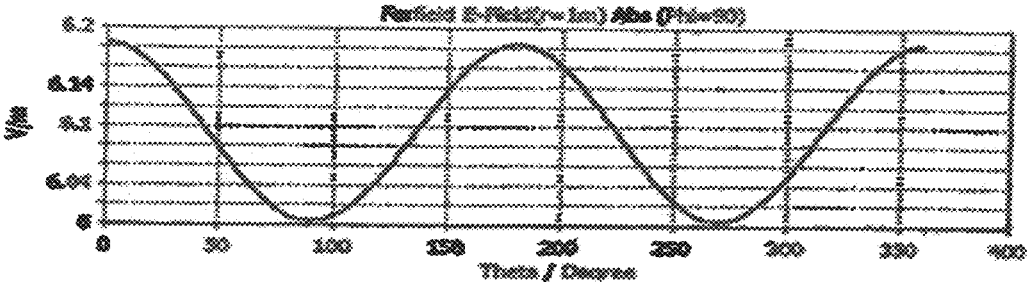
FIG. 9 of the drawings is a view showing changing a maximal field density around the radiator at a distance of 1 m as a result of a simulation using the construction of FIG. 6 of the wide band antenna according to the present invention.

In FIG. 9 of the drawings change of maximal field density around of the radiator of the wide band antenna according to the present invention at distance 1 m as a result of simulation using the construction on FIG. bis presented. The results show that the antenna emits practically the same in all directions. Main parameters of a "large" antenna version of the wide band antenna according to the present invention at different frequencies are presented in Table 1.

TABLE 1

| F, GHz | Emax, V/m | Gain, dB |
|---|---|---|
| 0.7 | 5.4 | 1.9 |
| 1 | 6.4 | 2.2 |
| 1.3 | 6.9 | 2.8 |
| 1.6 | 7.6 | 3.8 |
| 1.9 | 7.1 | 4.1 |
| 2.2 | 6.6 | 2.7 |

Figure 10:
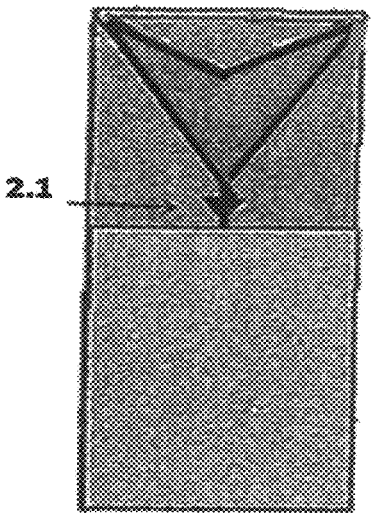
FIG. 10 of the drawings is a view showing a possible combination of a double triangle radiator and a PCB of the wide band antenna according to the present invention, in a small cellular phone.

FIG. 10 further schematically illustrates a wide band antenna according to the present invention with a combination of a double triangle radiator (2.1) and a PCB (5.1) in a "small" cellular phone. Ali dimensions are given in mm. In this case the height of the double triangle was decreased and an upper conductive line (10.1) was added. This improves a short monopole by turning it into a "T-antenna".

Figure 11:
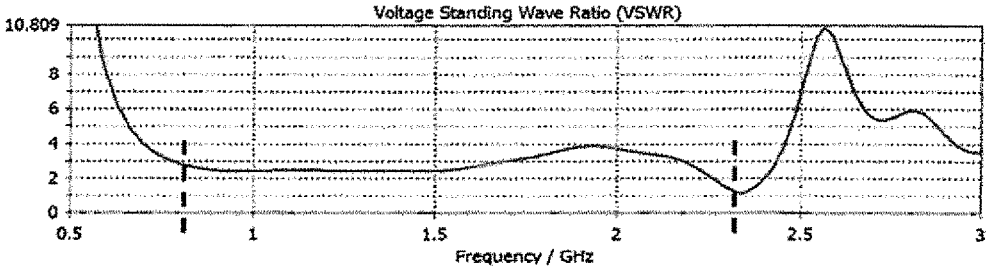
FIG. 11 of the drawings is a view showing a Voltage Standing Wave Ratio (VSWR) as a result of a simulation using the construction of FIG. 10 of the wide band antenna according to the present invention.
Figure 12:
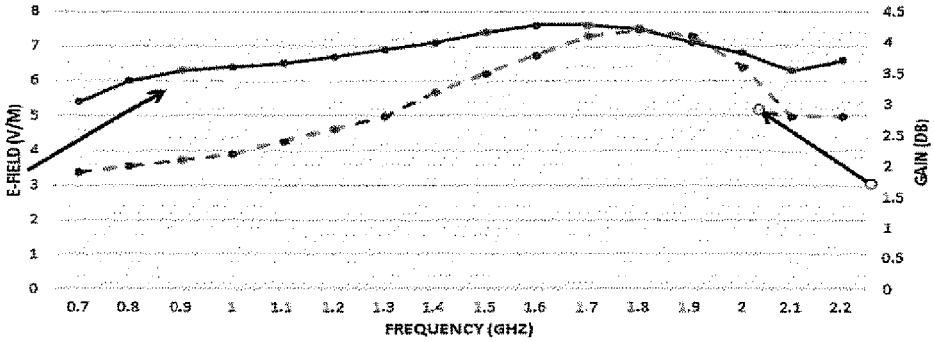
FIG. 12 of the drawings is a view showing a maximal field density at a distance 1 m and a gain as a result of a simulation using the construction of FIG. 10 of the wide band antenna according to the present invention.

A view showing a Voltage Standing Wave Ratio in the wide band antenna according to the present inventions a result of simulation using the construction on FIG. 10 is presented in FIG. 11. The source input resistance here is equal to 100 Ohm A further view illustrating a maximal field density of the wide band antenna according to the present invention at a distance 1 m and a gain as a result of simulation using the construction of FIG. 6 is presented in FIG. 12. These results show that the main parameters of this antenna practically do not depend of frequency.

Figure 13:
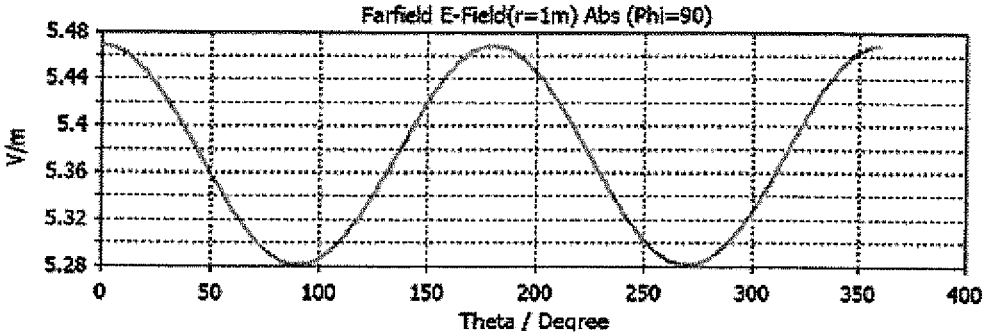
FIG. 13 of the drawings is a view showing a change of maximal field density around of the radiator at a distance 1 m as a result of a simulation using the construction on FIG. 10 shown in detail of the wide band antenna according to the present invention.

In FIG. 13 of the drawings is a view showing a change of a maximal field density around the radiator at a distance 1 m of the wide band antenna according to the present inventions as a result of simulation using the construction of FIG. 10. The results show that the antenna emits practically the same in all directions.

Main parameters of a "small" antenna version of the wide band antenna according to the present invention at different frequencies can be seen in Table 2.

TABLE 2

| F, GHzc | Emax, V/m | Gain, dB |
|---|---|---|
| 0.7 | 5.4 | 1.9 |
| 1 | 6.4 | 2.2 |
| 1.3 | 6.9 | 2.8 |

TABLE 2-continued

| F, GHzc | Emax, V/m | Gain, dB |
|---|---|---|
| 1.6 | 7.6 | 3.8 |
| 1.9 | 7.1 | 4.1 |
| 2.2 | 6.6 | 2.7 |

Figure 14:
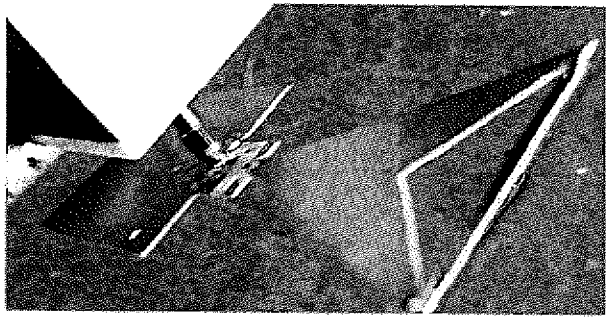
FIG. 14 of the drawings is a view showing an experimental model of the wide band antenna according to the present invention.

An experimental model of the proposed wide band antenna, according to the present invention is shown in FIG. 14 (photo).

Figures 15, 16:
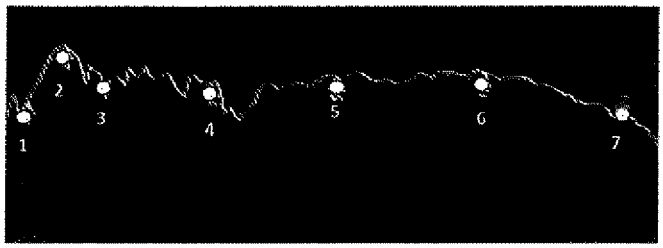
FIG. 15 of the drawings is a view showing measurements of parameters values of the antenna model of FIG. 14 of the wide band antenna according to the present invention.
FIG. 16 of the drawings is a view showing measurements of directivity values of the antenna model of FIG. 14 of the wide band antenna according to the present invention.

FIG. 15 (photo) is a view showing measurement values of parameter S21 of the wide band antenna according to the present invention, which correspond to a field density at a distance 1 m. These results confirm that in the wide band antenna according to the present invention basic parameters do not depend on frequencies within of a needed frequency band.

It can be seen from data on FIG. 16 of the drawings showing the antenna model that the wide band antenna according to the present invention is omni directional.

Figure 17:
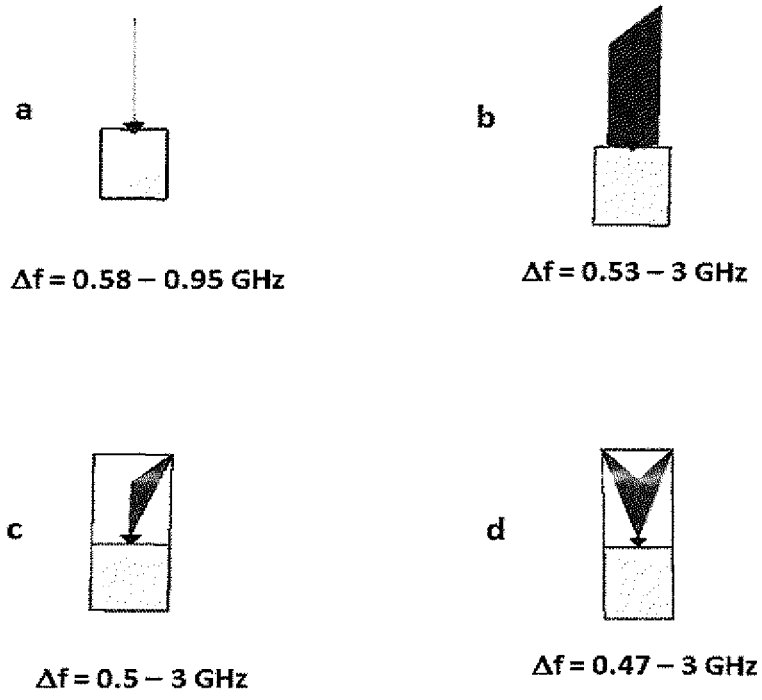
FIG. 17 of the drawings is a view showing different versions (b, c and d) of proposed antenna by comparison with a well-known monopole (a)
Figure 18:
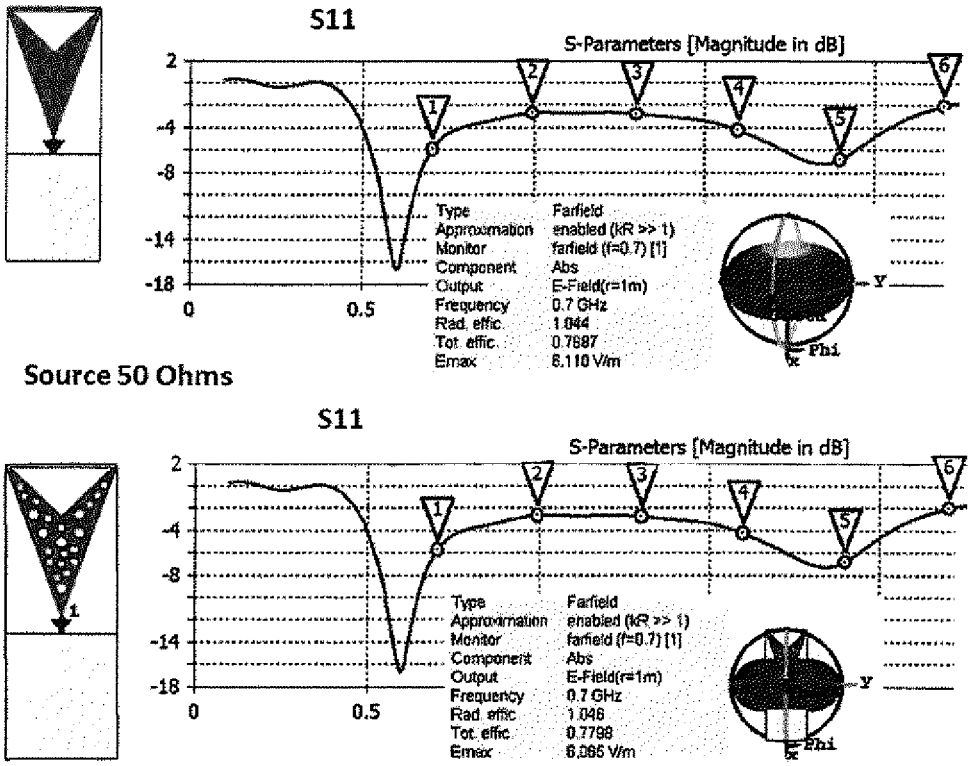
FIG. 18 of the drawings is a view showing holes in an antenna radiator for placing elements that do not work on a frequency of radiation of the antenna

Various variants of the proposed antennas can be constructed as shown in FIG. 17. Option 17*a* is a well-known monopole, given for comparison. Option 17*b* is an antenna with a rectangular radiator and with a beveled upper side. Option 17*c* is an option with a triangular radiator. Option 17*d* is an option with a double triangular radiator. In each version the antenna emission bandwidth is at a level of 3 dB levels. It can be seen that in all embodiments according to the present invention there is a wider band than in a monopole with a linear radiator. In cases of a small transducer it is possible to use an electrically conductive plate with holes. In these holes elements of a circuitry can be provided, which do not operate at a working radiating frequency. It can be seen from FIG. 18 that these holes do not deteriorate main parameters of antenna All the results presented above in the figures and tables confirm that the wide band antenna according to the present invention operates almost identically at all frequencies of a wide range.

In fact, the frequency range can be significantly expanded. This follows from the fact that the radiator of the wide band antenna according to the present invention operates both with its quarter-wavelength and with an odd number of quarters of the wavelength, i.e. increasing frequency. However, in this case it is necessary to take into account the changes in the radiation resistance of the antenna. Methods for taking into account the changes in the radiation resistance of the antenna are disclosed for example in [2].

The present invention is not limited to the details disclosed above since various modification and structural changes are possible without departing from the spirit of the invention.

What is desired to be protected by Letters Patent is set forth in particular in the appended claims in the present application.

What is claimed is:

1. An omni directional wide band antenna, having a single radiator consisting exclusively of a single electrically conductive plate, wherein the single electrically conductive plate has a shape of a single non-rectangular triangle having all straight sides including two straight lateral sides of different lengths with first ends of the lateral sides connected with one another in a point connectable to an electric signal source and other opposite second ends, and wherein the single electrically conductive plate also has a straight side which is opposite to the point connectable to the electric signal source and connects the opposite second ends of the lateral sides with each other thus forming a third side of the non-rectangular triangle; wherein a length of a longest one of the lateral sides is not shorter than a quarter of a wave length of a radiation of a desired lower frequency, while a length of a shortest one of the lateral sides is no longer than a quarter of a wavelength of a radiation of a desired highest frequency.

2. The antenna of claim 1, wherein the single electrically conductive plate has a plurality of through going openings.

* * * * *